US007854883B2

(12) United States Patent
Kueppers et al.

(10) Patent No.: US 7,854,883 B2
(45) Date of Patent: Dec. 21, 2010

(54) SYSTEM FOR COOLING SHAPE-ROLLED RAILS

(75) Inventors: Klaus Kueppers, Erkrath (DE); Meinert Meyer, Erkrath (DE); Thomas Nerzak, Gelsenkirchen (DE); Uwe Plociennik, Ratingen (DE)

(73) Assignee: SMS Meer GmbH, Monchengladbach (DE)

( * ) Notice: Subject to any disclaimer, the term of this patent is extended or adjusted under 35 U.S.C. 154(b) by 593 days.

(21) Appl. No.: 11/880,635

(22) Filed: Jul. 23, 2007

(65) Prior Publication Data

US 2008/0018027 A1 Jan. 24, 2008
US 2010/0207305 A9 Aug. 19, 2010

Related U.S. Application Data

(62) Division of application No. 10/485,286, filed as application No. PCT/EP02/08271 on Jul. 25, 2002, now abandoned.

(30) Foreign Application Priority Data

Aug. 1, 2001 (DE) ..... 101 37 596

(51) Int. Cl.
*C21B 7/24* (2006.01)

(52) U.S. Cl. ..... 266/81; 266/114

(58) Field of Classification Search ..... 266/114, 266/79, 81

See application file for complete search history.

(56) References Cited

U.S. PATENT DOCUMENTS

| | | | | |
|---|---|---|---|---|
| 4,243,441 | A * | 1/1981 | Wilson | 148/508 |
| 6,689,230 | B1 * | 2/2004 | Meyer et al. | 148/508 |
| 2004/0187974 | A1 * | 9/2004 | Kuppers et al. | 148/511 |

FOREIGN PATENT DOCUMENTS

| | | |
|---|---|---|
| DE | 1013759 | 2/2003 |
| WO | WO-03/012151 | 2/2003 |

* cited by examiner

*Primary Examiner*—Scott Kastler
(74) *Attorney, Agent, or Firm*—Andrew Wilford

(57) ABSTRACT

A system for cooling a hot rail of rail steel to a fine perlitic or ferritic or perlitic/ferritic structure has a plurality of separate cooling modules with independently adjustable cooling parameters. The rail is guided downstream through the modules of the cooling stretch and through intermediate zones between the modules so as to cool the surface of the rail in each of the modules and to subject the rail to destressing or stress relief between the modules. Sensors in each of the intermediate zones detect the actual surface temperature of the rail in the respective zones, and a controller connected to the modules and to the sensors varies the cooling parameters of the cooling modules in dependence on the detected temperatures in the respective upstream zones to ensure a defined temperature in the rail that lies above a critical temperature at which bainitic structure components are formed.

8 Claims, 3 Drawing Sheets

SYSTEM FOR COOLING SHAPE-ROLLED RAILS

CROSS REFERENCE TO RELATED APPLICATIONS

This application is a division of U.S. patent application Ser. No. 10/485,286 filed 26 Jan. 2004 now abandoned, as the US national phase of PCT application PCT/EP2002/008271, filed 25 Jul. 2002, published 13 Feb. 2003 as WO 2003/012151, and claiming the priority of German patent application 10137596.4 itself filed 1 Aug. 2001.

FIELD OF THE INVENTION

The invention relates to a method of cooling workpieces, especially for the cooling of rolled products and here to a method of cooling shape-rolled products or rolled structural shapes of rail steels with a fine perlitic or a ferritic/perlitic structure, whereby the hot workpiece, that is a workpiece with an austenitic structure, is passed through a cooling stretch with an inlet region and an outlet region and is subjected to a cooling process and as a result a transformation is carried out into a perlitic or ferritic/perlitic structure.

Rail steels are significant for the production of rails as well as of their connection elements and their fastening elements. The vertical and lateral forces which are applied by the wheel to the rail, like normal forces, traveling forces, acceleration forces and braking forces, give rise in the regions in which they are directly effective to extremely high dynamic stresses and, as a rule, to a plastic deformation of the steel. As a result of these loads, wear effects arise in the form of ablation of material, friction wear, material breakage, local workpiece fatigue or cracking. An improvement in the resistance of a rail to these wear effects can be achieved by increasing its elastic limit and tensile strength as well as its fatigue limit in combination with the provision of the finest possible striated perlitic structure.

Under normal cooling conditions using a cooling bed in accordance with the state of the art, rail steels undergo a transformation to a perlitic structure. In this manner rail steels with a ferritic/perlitic structure can reach tensile strength values in a range of 700 to 900 $N/mm^2$ while steels with a purely perlitic structure can achieve tensile strength values in excess of 900 $N/mm^2$. The significant properties of rail steels are determined by the proportion of the structure constituted by ferrite/perlite as well as by its morphological structure. Both in the case of ferritic/perlitic steels and in the case of perlitic steels, the lamellae spacing plays a role.

OBJECT OF THE INVENTION

The invention sets out as its object to provide a cooling process for the production of workpieces, especially shape rolled products from rail steel with improved properties and a fine striated perlite or ferrite/perlite structure.

SUMMARY OF THE INVENTION

According to the invention it is proposed that the workpiece, which is at its (rolling) heat, for example a rolled or optionally an extruded structural-shape product, is passed through a cooling stretch which is assembled from individual/independent cooling modules with independently adjustable cooling parameters, whereby between the cooling modules there are intermediate zones for thermal equalization or thermal stress relief with means for an actual temperature determination for the respective workpiece in this intermediate zone and whereby, in dependence upon the respective actual temperature value in the intermediate zone or in one of the intermediate zones, the specific cooling parameters, especially the cooling intensity, of the respective subsequent cooling module, are controlled in order to maintain a defined (surface) temperature during the entire passage along the cooling stretch, whereby the defined temperatures of the workpieces respectively each lie above a critical temperature at which the bainitic portions of the structure are formed.

The basic concept is, therefore, the control of the cooling of a workpiece of rail steel in a cooling stretch under the condition that the surface temperature of the workpiece of rail steel is so cooled that the desired perlitic or ferritic or perlitic/ferritic structure is established, whereby in the stress relief phases there is both a continuous monitoring of the temperature characteristics in preferably each intermediate zone and optionally regulation of the cooling parameters of the individual cooling modules to ensure that the temperature does not fall below a critical temperature so that under cooling cannot result in a bainitic transformation which can give rise to undesirable bainitic components in the structure.

The cooling process is carried out by the workpiece traversing cooling modules in individual cooling process steps and in dependence upon the conditions in the intermediate zones for stress relief of the structure in timed phases which can include reheating and/or timed phases in which thermal conditions are maintained and/or timed phases provide a slower cooling, taken together. The workpiece in all intermediate zones can be subjected to the same stress relief phase or can be subjected to different timed phases of stress relief in the various intermediate zones. The reheating can be effected either from residual heat from the interior of the workpiece and still present therein and/or from the supply of heat to the workpiece from the exterior. In this manner a somewhat sawtooth cooling pattern is established which has been found to be particularly effective in establishing the desired final internal structure of the workpiece and thus the mechanical properties thereof. The bainitic formation is counteracted in that the parameters of the cooling stretch are so set that at no point in time during the cooling process can bainite formation take place.

It is also provided by the invention that the intermediate zones are utilized for a thermal equalization over the workpiece, especially rolled products, or for the cooling thereof at slow cooling speeds.

Preferably the respective measured actual temperature value in each of the intermediate zones is utilized to control the specific cooling parameters of the respective subsequent cooling zone and simultaneously the cooling parameters of the respective preceding cooling modules. This means that the workpiece or rolled product to the extent that it deviates from a predetermined set-point temperature at a certain point in time or in a particular intermediate zone, is brought back to the set-point temperature by a specific change in the cooling parameters of the subsequent cooling module and at the same time the preceding cooling module is adjusted for the next workpiece to follow in the sequence.

Advantageously, the surface temperature of the workpiece is detected at the end of the intermediate zone, i.e. following the end of the region in which structure destressing occurs. The temperature measurement in the intermediate zone can also be used for quality monitoring.

According to a preferred embodiment, the surface temperature measurement is effected by an optical and contactless measuring device, that is by means of a pyrometer.

The control of the cooling parameters and here especially the cooling intensity is effected preferably by means of control of the pressure with which the cooling medium is directed onto the surface of the workpiece and/or by means of regulation or regulated adjustment of the temperature of the cooling medium and/or by means of controlled adjustment of the volume rate of flow of the cooling medium by selection of the cooling nozzle geometry. As the cooling medium, preferably cooling water is used.

The pressure control is effected preferably by means of a pressure control valve in the inlet to the nozzles and which may be arranged on the cooling beams. The cooling intensity is also controllable by utilizing different numbers of nozzles per cooling beam or cooling beam arrangements.

According to an especially preferred embodiment of the temperature control of the cooling medium it is proposed that the cooling medium, that is especially cooling water, before its impingement upon the workpiece surface, is preheated at least to the extent that undershooting of the Leidenfrost temperature dos not occur or is very greatly delayed.

The Leidenfrost phenomenon is a nonwetting property of a liquid when the temperature of the contacted body lies above the boiling temperature of the liquid. Water, for example, is protected by a gas skin of vaporized water from further evaporation and thus loses for a certain time its cooling effectiveness. By preheating the cooling water it is possible to influence the Leidenfrost temperature. The Leidenfrost temperature increases with increasing cooling water temperature at the inlet and the cooling effect is weakened. So that an undershoot of the Leidenfrost temperature will not occur or will be delayed significantly, it is proposed to preheat the cooling water. This offers the possibility of weakening the cooling effect and making it more reproducible.

According to a preferred method step, the temperature of the workpiece before or upon entry into the cooling stretch is measured and based upon this temperature measurement the cooling parameters of the cooling line are preset especially in terms of the adjustment of the pressure with which the cooling medium is directed upon the workpiece surface.

BRIEF DESCRIPTION OF THE DRAWING

Further details and advantages of the invention will be obtained from the following description in which the embodiments of the invention illustrated in the figures are described in greater detail.

Apart from the previously described combinations of features, features of the invention can be taken alone or can be considered significant to others in other combinations. In the drawing.

SPECIFIC DESCRIPTION

Figure 1:
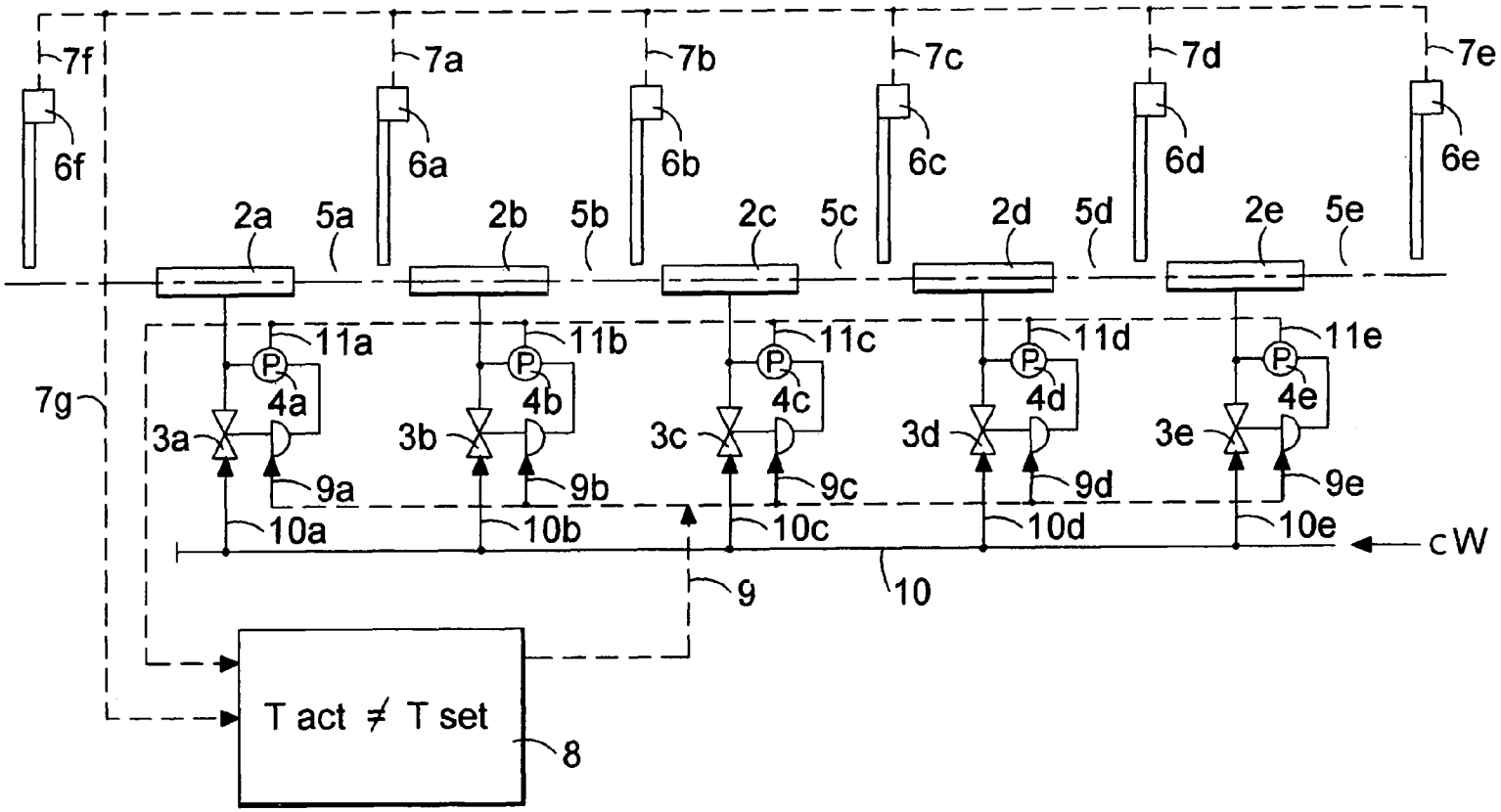
FIG. 1 is a schematic overview of a cooling stretch in which the method of the invention is carried out.

The cooling stretch 1 illustrated in FIG. 1 is connected to a structural shape rolling line (not illustrated), for example, a rolling line for rail structural shapes of rail steels. The cooling stretch 1 is comprised, in the illustrated embodiment, of five cool modules 2*a-e*, but is not however limited to this number of cooling modules. The individual cooling modules 2*a*-2*e* are for example so constructed that they encompass one or more cooling beams or cooling nozzle arrangements. The pressure with which the cooling water emerges from the individual nozzles is adjustable by means of the respective pressure control valves 3*a-e*. The actual pressure is measured by means of the pressure measuring devices 4*a-e*. Between the individual cooling modules 2*a-e*, intermediate zones 5*a-e* are arranged. At each end of an intermediate zone 5*a-e* a pyrometer 6*a-e* is located for the contactless optical measurement of the surface temperature of the rolled product found in this intermediate zone, whereby in the case of a rail structure shape, the surface temperature at the rail head is measured.

Upstream of the first cooling module 2*a* at the inlet region or beginning of the cooling stretch 1 an additional pyrometer 6*f* is disposed. The individual pyrometers 6*a-f* are connected by means of signal connectors 7*a-f* with a computer unit 8. The computer unit 8 is connected by corresponding control conductors 9*a-e* to the individual control valves 3*a-e* for the cooling nozzles to vary the settings of these control values. The cooling medium, especially cooling water (cw) is supplied by a common feed pipe 10 with branches 10*a-e* connected to the individual cooling modules 2*a-e*.

For regulating the pressure values, there is in addition a control circuit of the pressure measurement devices 4*a-e* for the computer 8 (signal conductors 11*a-e*).

In the following, the process is described. Prior to entry of the rolled structure shape of steel, preferably a rail, into the cooling stretch by means of the first pyrometer 6*f*, for example a two-color pyrometer, an actual surface temperature value is taken. This first surface temperature value is fed to the computer unit 8 which has already been provided with a presetting in response to this individual value for the individual control values for the setting of the cooling water pressure as well as the cooling water temperature. After the workpiece has traversed the first cooling module 2*a* it enters the first intermediate zone 5*a* in which a relief or destressing phase for the structure is effected. At the end of the first intermediate zone 5*a*, by means of a second pyrometer 6*a*, for example a two-color pyrometer, a further surface temperature measurement ($T_{ACT}$). This actual value is transferred to the computer unit 8 over the signal lines 7*a* and 7*f* and then a difference calculation is carried out between a set-point value $T_{SET}$ and the actual value $T_{ACT}$. The set-point value always lies immediately above a workpiece-specific temperature at which bainite formation can arise. The set-point values are alloy-specific and can be obtained by experiments. A determining factor for this critical temperature below which the rail steel should not be cooled, is about 450 to 500° C.

To the extent that there is a difference between the actual value and the set-point value, the subsequent or a plurality of subsequent cooling modules have their cooling parameters adjusted, here by varying the pressure control valves 3*a*-3*e* which regulate the pressure of the cool water directly onto the workpieces. The regulation of the pressure values in dependence upon a measure of the actual pressure value is carried out continuously.

The described control is repeated in dependence upon the respective temperature values detected in each further intermediate zone. Preferably not only is each subsequent cooling module adjusted but also the preceding cooling module is adjusted for each measured value which then affects the subsequent rolled workpiece to be cooled.

Figure 2:
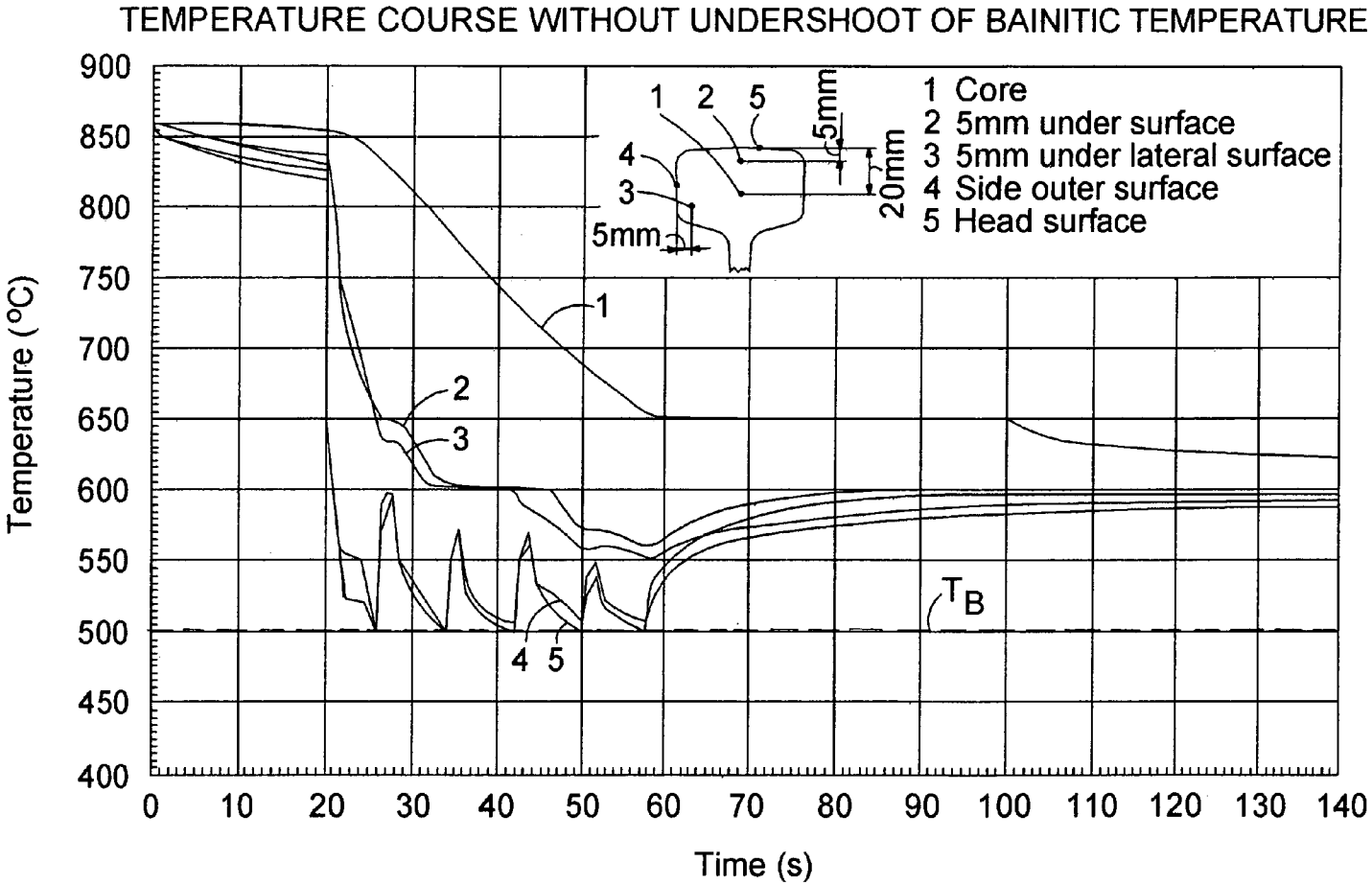
FIG. 2 is a temperature-time diagram with the cooling curves of five measurement points in or on the railhead of a usual rail steel with about 0.8% C and 1.0% Mn which is subjected according to the invention to such a cooling pattern in a cooling stretch according to the invention in which the bainitic temperature is not undershot.
Figure 3:
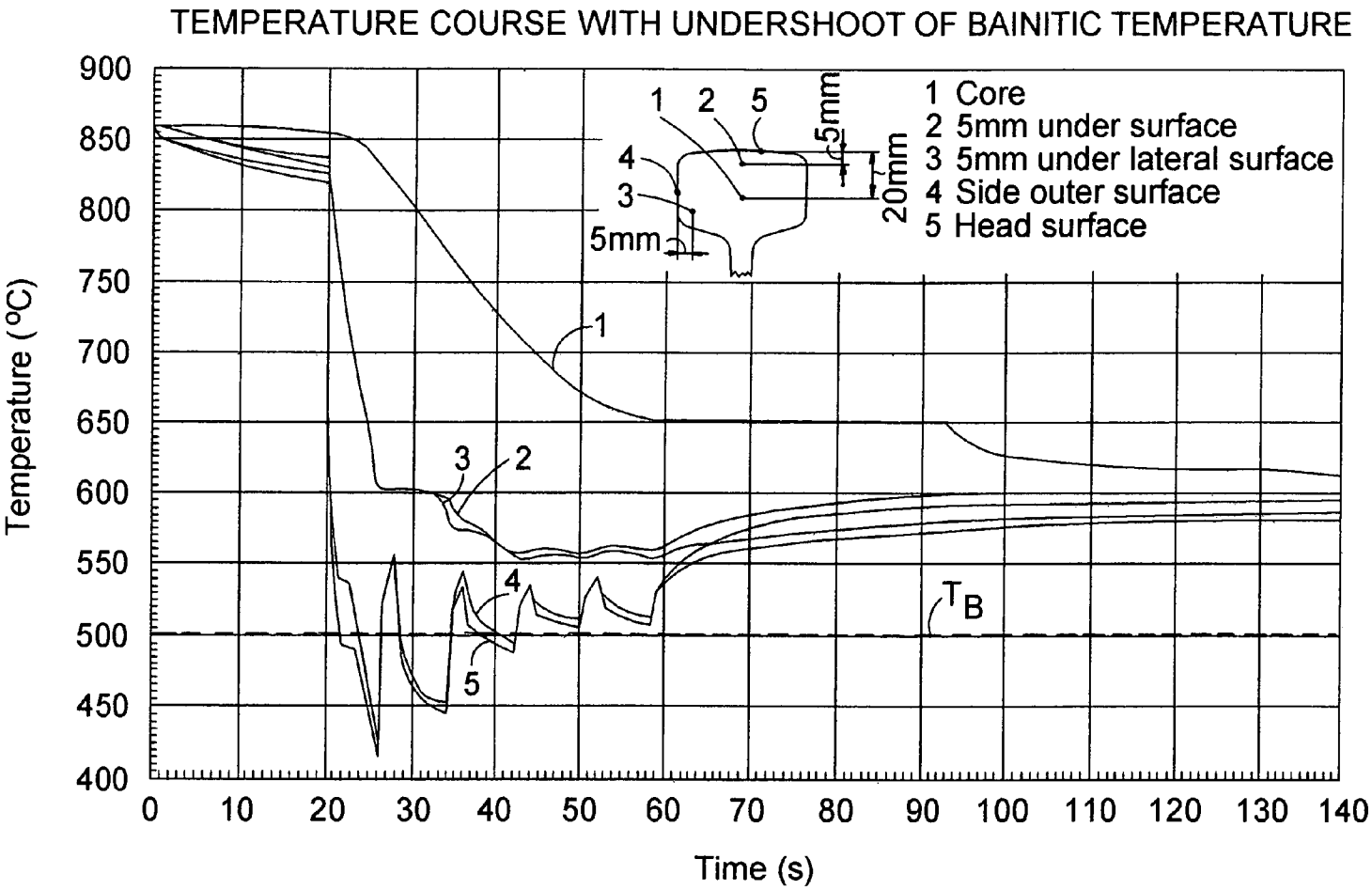
FIG. 3 for comparison is a temperature-time diagram of the five cooling curves of an unregulated course of cooling where the bainite temperature is undershot.

FIGS. 2 and 3 show with the aid of temperature-time diagrams the cooling curves for the rail heads of a material with 0.8% carbon with control and without control. The designation C80W60 or C80W65 makes clear that the cooling speed in the core of the rail head (for example a rail shape in accordance with AREA 136) [Standard of American Railway Engineering Association] is significantly higher than in the boundary and that in the core transformation of austenite to perlite or ferrite-perlite occurs at elevated temperatures.

The temperature course over time was taken for five different measurement points at the rail head. At 1 was the measurement point in the core of the rail head. 2 was a measurement point which was located 5 mm below the surface. 3 was a measurement point which was located 5 mm below a lateral surface. 4 was a measurement point on the lateral surface. 5 was a measurement point on the head surface. It can be seen that at no time at any measurement point did the structure of the rail head suffer an undercooling that could have given rise to a bainite structure.

The simulated cool stretch had five modules which were individually controllable. The individual cooling curves are illustrated in FIG. 2 and in no case was the critical temperature, at which bainite formation could set in, undershot. On the cooling curves 4 and 5 which indicate the cooling at the surface of the rail head, the sawtooth cooling pattern is clearly shown and involved reheating in the intermediate or equalization zones.

FIG. 3 shows by comparison a cooling stretch with five cooling modules which are not individually controllable so that the bainite temperature can be undershot in the regions close to the surface (curves 4 and 5) of the rail head.

With the method proposed, a cooling of rail steels from the rolling heat can be carried out to yield a fine perlitic or ferritic/perlitic structure without the mechanical properties and especially the wear properties being negatively affected by bainitic components.

We claim:

1. A system for cooling a hot steel rail to a fine perlitic or ferritic or perlitic/ferritic structure, the system comprising:

a plurality of separate cooling modules with independently adjustable cooling parameters and intermediate zones between the cooling modules, the cooling modules together forming a cooling stretch, the rail passing downstream through the modules of the cooling stretch and the intermediate zones therebetween so that the surface of the rail is cooled in each of the modules and the rail is subjected to destressing or stress relief in the intermediate zones between the modules;

sensors in each of the intermediate zones for detecting the actual surface temperature of the rail in the respective zones;

control means connected to the modules and to the sensors for varying the cooling parameters of the cooling modules by pressure control and/or temperature control of a fluid cooling medium in dependence on the detected temperatures in the respective upstream zones to ensure a defined temperature in the rail that lies above a critical temperature at which bainitic structure components are formed; and means for preheating the cooling medium before impingement upon the rail surfaces such that an undershoot of the Leidenfrost temperature does not occur or occurs later than with nonpreheated cooling medium.

2. The system defined in claim 1 wherein the control means carries out the cooling in timed phases of reheating and/or timed phases of retention of heat and/or in timed phases of slow cooling in combination.

3. The system defined in claim 1 wherein the means controls the specific cooling parameters of the respective downstream cooling modules and simultaneously the cooling parameters of preceding cooling modules in dependence upon the respective measured actual temperature value of one or any intermediate zone.

4. The system defined in claim 1 wherein the sensors are located at upstream ends of the respective intermediate zones.

5. The system defined in claim 1 wherein the sensors are optical and contactless.

6. The system defined in claim 1, further comprising sensor means for measuring temperature of the rail before entry or upon entry into the cooling stretch, the control means being connected to this sensor means for presetting the cooling parameters of the individual cooling modules.

7. The system defined in claim 1, further comprising a series of hot-rolling stands upstream of the cooling stretch feeding hot-rolled rails to the cooling stretch.

8. The system defined in claim 1 wherein the cooling medium is water.

* * * * *